US007918249B2

(12) United States Patent
Moser

(10) Patent No.: US 7,918,249 B2
(45) Date of Patent: Apr. 5, 2011

(54) APPARATUS FOR THE PRODUCTION OF LENO FABRIC

(75) Inventor: Pascal Moser, Rüschlikon (CH)

(73) Assignee: Groz-Beckert KG, Albstadt (DE)

( * ) Notice: Subject to any disclaimer, the term of this patent is extended or adjusted under 35 U.S.C. 154(b) by 222 days.

(21) Appl. No.: 12/292,498

(22) Filed: Nov. 20, 2008

(65) Prior Publication Data

US 2009/0139580 A1 Jun. 4, 2009

(30) Foreign Application Priority Data

Nov. 21, 2007 (EP) ..... 07022627

(51) Int. Cl.
*D03C 7/06* (2006.01)
*D03C 7/00* (2006.01)
*D03C 13/00* (2006.01)

(52) U.S. Cl. ..... 139/35; 139/11; 139/55.1; 139/91

(58) Field of Classification Search ..... 139/1 E, 139/11, 35, 48, 50, 51–54, 55.1, 82–84, 87, 139/91, 455, 456
See application file for complete search history.

(56) References Cited

U.S. PATENT DOCUMENTS

| | | | | |
|---|---|---|---|---|
| 2,043,165 | A * | 6/1936 | Hall, Jr. | 139/47 |
| 3,015,346 | A * | 1/1962 | Kaufmann | 139/52 |
| 3,255,783 | A * | 6/1966 | Wall | 139/50 |
| 3,353,569 | A * | 11/1967 | Koch | 139/51 |
| 3,612,108 | A * | 10/1971 | Schwarz | 139/50 |
| 3,640,314 | A * | 2/1972 | Strauss | 139/436 |
| 3,990,481 | A * | 11/1976 | Graf | 139/52 |
| 4,066,105 | A * | 1/1978 | Heinrich et al. | 139/54 |
| 4,415,007 | A * | 11/1983 | Kleiner | 139/329 |
| 4,463,782 | A * | 8/1984 | Borel | 139/55.1 |
| 4,687,029 | A * | 8/1987 | Takada | 139/84 |
| 4,967,802 | A * | 11/1990 | Klocker | 139/51 |
| 5,040,571 | A * | 8/1991 | Klocker et al. | 139/52 |
| 6,102,080 | A * | 8/2000 | Hockemeyer et al. | 139/52 |
| 6,116,291 | A * | 9/2000 | Hockemeyer et al. | 139/51 |
| 6,244,304 | B1 * | 6/2001 | Hockemeyer et al. | 139/54 |
| 6,311,737 | B2 * | 11/2001 | Wahhoud et al. | 139/50 |
| 6,955,191 | B2 * | 10/2005 | Hockemeyer et al. | 139/52 |
| 7,287,553 | B2 * | 10/2007 | Wahhoud | 139/50 |
| 2001/0013377 | A1 * | 8/2001 | Wahhoud et al. | 139/54 |
| 2004/0108012 | A1 * | 6/2004 | Hockemeyer et al. | 139/11 |

FOREIGN PATENT DOCUMENTS

CH 391595 4/1965

* cited by examiner

*Primary Examiner* — Bobby H Muromoto, Jr.
(74) *Attorney, Agent, or Firm* — Fitch, Even, Tabin & Flannery; Norman N. Kunitz

(57) ABSTRACT

A leno device uses the link mechanisms (31, 31') to derive the movement of its half shaft (28) from the movement of its pull or lifting shafts (2, 3). The link mechanisms (31, 31') connect the shaft rods (4, 5) of the pull or lifting shafts (2, 3) to the half shaft (28), whereby a connecting rod (32, 32') extends between the two pull or lifting shafts (2, 3) from the top to the bottom through said shafts. The upper end of the connecting rod (32, 32') is connected, on both sides of the connecting rod (32 32') via connecting levers (33, 34, 33' 34'), to the joints (36, 37, 36', 37') that are connected to the upper shaft rods (4, 5) of the pull or lifting shafts (2, 3).

9 Claims, 8 Drawing Sheets

APPARATUS FOR THE PRODUCTION OF LENO FABRIC

CROSS-REFERENCE TO RELATED APPLICATION

The present application claims the priority of European Patent Application No. 07 022 627.9, filed Nov. 21, 2007, the subject matter of which, in its entirety, is incorporated herein by reference.

BACKGROUND OF THE INVENTION

The invention relates to a leno device.

Leno devices are used for the production of leno fabric. A leno fabric is a fabric in which at least two warp threads do not run parallel to each other, but loop around each other. For example, a warp thread moves as the standing thread straight through the fabric, while another warp thread is moved as a loop thread zigzagging over or under the standing thread and, alternately, forms—on the one or the other side, a downward or upward directed loop for receiving the weft thread. In order to illustrate this, FIG. 8 shows, schematically, a detail of a leno fabric with standing threads S1, S2, S3, S4, loop threads S5, S6, S7, S8, and warp threads K1, K2, K3. Illustrated here is a simple structure that can be designed so as to be complex as desired.

In order to produce such fabrics, the mentioned leno devices are used, these being shown, e.g., by document CH 391595. The leno device is also referred to as a "doup warp heald frame" and is divided into two lifting shafts and one half shaft. While the lifting shafts of a dobby are driven by, e.g., a rod assembly, so as to move up and down in vertical direction, the half shaft is moved by a spring-biased yoke which is alternately carried (in downward direction) by one or the other pull shaft. Such a system certainly works, however, the operating speed must remain restricted. In fact, weaving machines with such leno devices are operated in the range of 150 to a maximum of 250 wefts per minute. Due to the low productivity achieved in this manner, the produced fabrics become extremely expensive and, consequently, their use remains greatly restricted.

It is the object of the present invention to provide an apparatus for driving the half shaft, said apparatus permitting the production of leno fabrics by means of lifting healds and half healds at a substantially higher weft speed. In particular, the apparatus should be simple and robust.

SUMMARY OF THE INVENTION

This object is achieved with the leno device in accordance with claim 1.

The leno device comprises two lifting shafts and one half shaft and, combined, is also referred to as the doup warp heald frame. A transmission connects the half shaft with the lifting shafts in order to derive the movement of the half shaft from the movement of the lifting shafts. As a result of the provided forced coupling of the movement of the half shaft with the movement of the lifting shafts, this is achieved in a shock-free manner and thus permits high operating speeds. In order to achieve such high operating speeds, no additional devices whatsoever are necessary on the dobby or on the eccentric dobby used to drive the lifting shafts. Nevertheless, a positive-locking, and thus forced guided or running, drive of the half shaft takes place. The half shaft carries out a smooth movement. The movement can be represented by a limited number of harmonic functions. The transmission defines a path/time curve for the half shaft that can be continuously differentiated, provided the lifting shafts also move consistent with a continuously differentiated path/time law.

The transmission preferably is a link mechanism which derives the movement of the half shaft at least from the movement of one of the lifting shafts, but preferably also from the movement of both lifting shafts. The transmission preferably comprises a connecting rod whose on end is pivotally connected to the half shaft. The other end of the connecting rod is preferably pin-connected via two equally long connecting levers, said levers being configured as guide rods, to the two lifting shafts. Preferably, the two guide rods have the same length. Preferably, the connecting rod is considerably longer than the guide rod. Preferably, it is at least twice as long as said rods. In addition, the connecting rod joint is preferably connected in the center between two joints, by way of which the guide rods are connected to the lifting shafts.

The lifting shaft is preferably driven by at least two same-type link mechanisms of the lifting shafts. To do so, the link mechanisms are arranged at a certain distance from each other. Their configuration may be identical or be mirror-symmetrical to each other.

Furthermore, preferably, the length of the connecting rod is adjustable. A corresponding adjustment device may be provided on the connecting rod, the connecting rod joint or also on the joint that connects the connecting rod with the guide rods.

As needed, the leno device may be represented by two heald shafts above the center of the shed, said shed being formed by at least two heald shafts, or below the center of the shed.

Additional details of advantageous embodiments of the invention are the subject matter of the description, the drawings or the claims. The description is restricted to essential aspects of the invention and miscellaneous situations. The drawings disclose additional details and are to be considered supplementary.

DETAILED DESCRIPTION OF THE INVENTION

Figure 1:
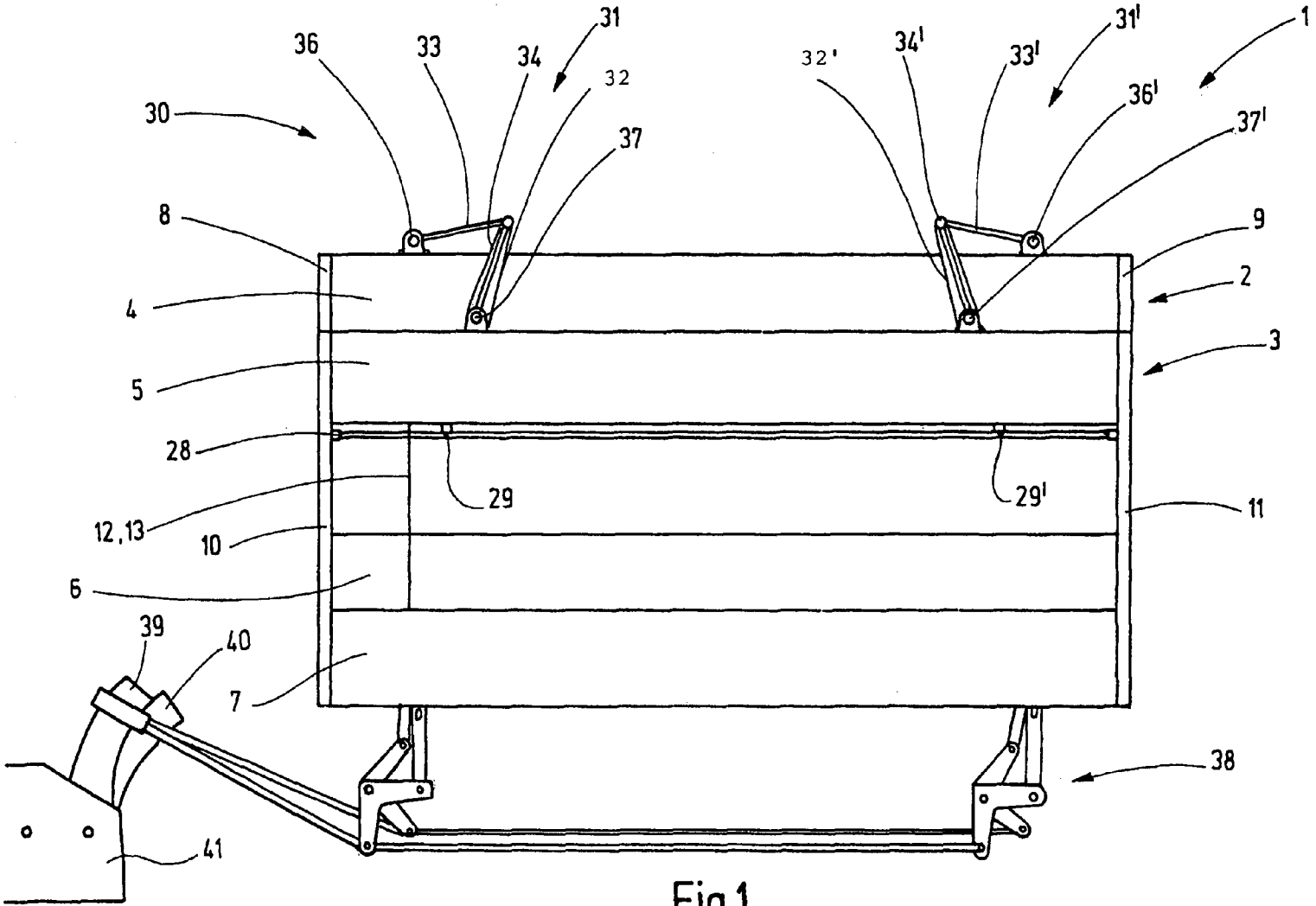
FIG. 1 is a schematic front view of a leno device with a drive.
Figure 2:
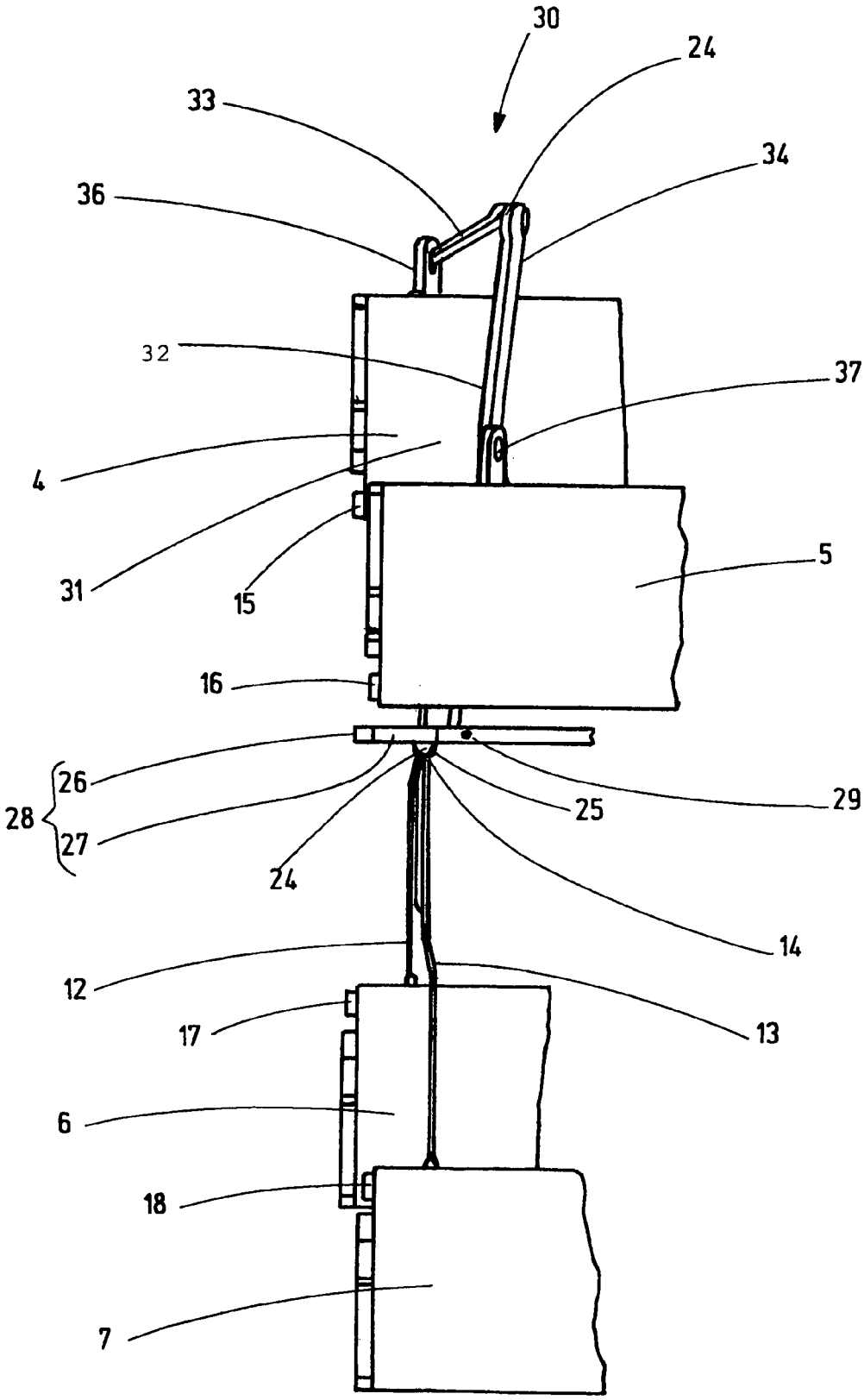
FIG. 2 is a perspective view, partially in section, of the leno device in accordance with FIG. 1.
Figure 3:
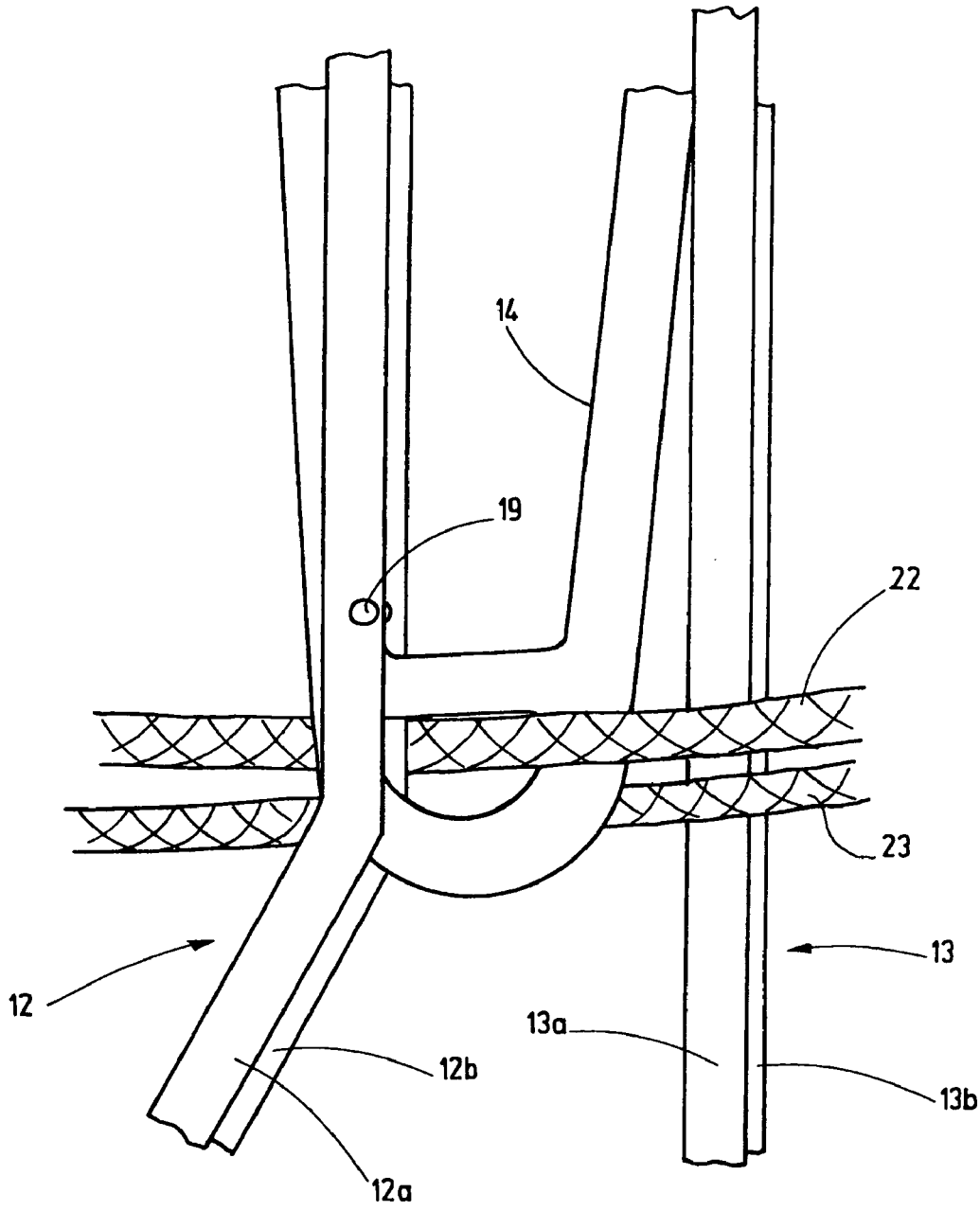
FIGS. 3 and 4 are separate illustrations of details of the healds of the leno device in different operating phases.
Figure 4:
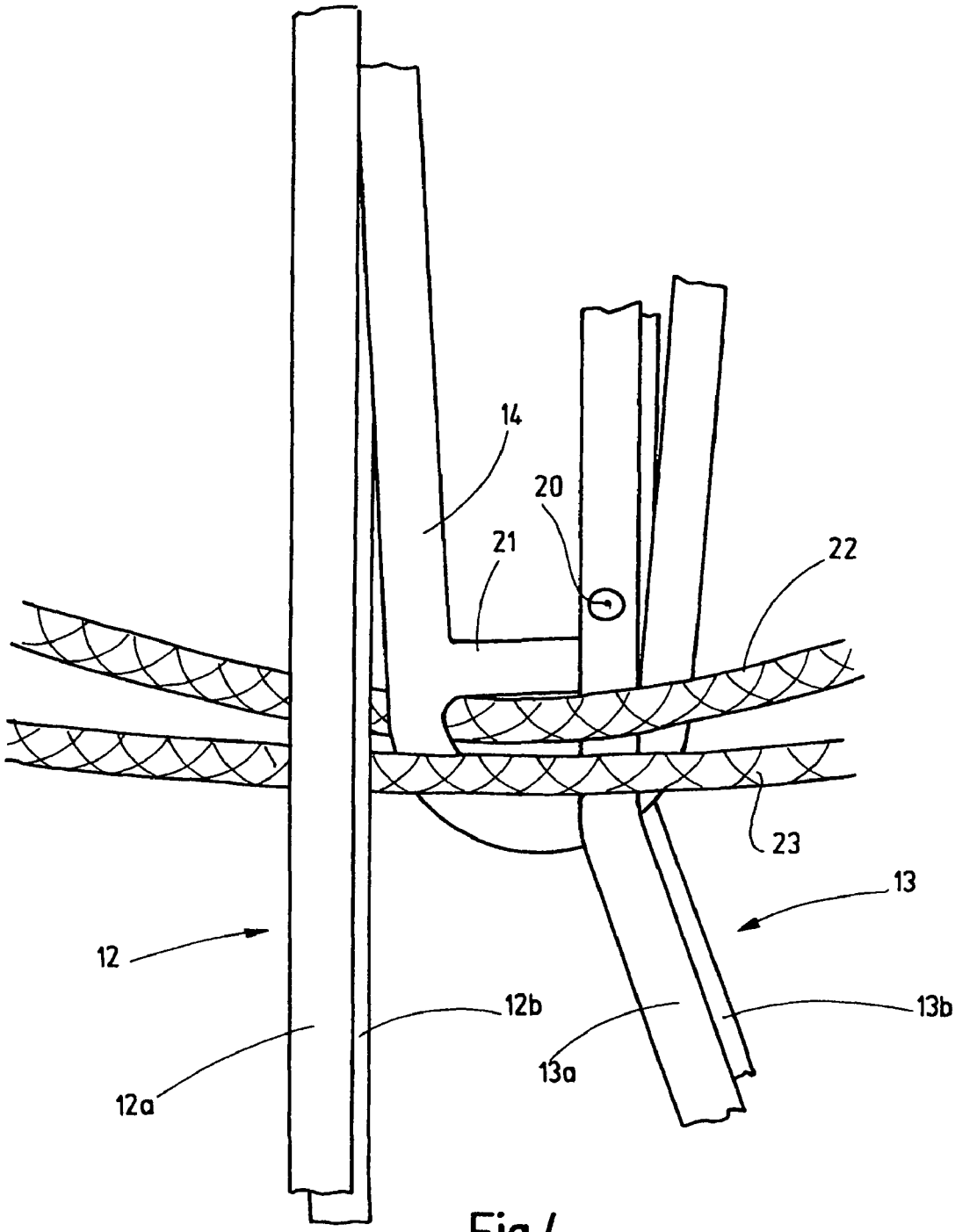

FIG. 1 shows a leno device 1 that is also referred to as a doup warp heald frame. This leno device 1 is arranged above the center of the shed that is formed by at least two heald shafts. If desired, it may also be arranged below the center of the shed and is then configured in a mirror-symmetrical manner with respect to the leno device shown in FIG. 1. The leno device 1 comprises two lifting shafts 2, 3, each comprising an upper shaft rod 4, 5 and a lower shaft rod 6, 7. The shaft rods 4 and 6 are connected to each other by lateral supports 8, 9 in order to form a rectangular, mostly rigid frame. The shaft rods 5, 7 are also connected to each other by lateral supports 10, 11, thus again forming a rigid frame. Each of the shaft rods 4, 5, 6, 7 is provided with heald support rails that, as is shown by FIG. 2, support lifting healds 12, 13. Sometimes, these are also referred to as pull healds. This is true, in particular, when a half heald 14 is suspended between them, as is shown by FIGS. 3 and 4.

The pull or lifting healds 12, 13 have end eyelets that are used to seat them on the heald support rails 15, 16, 17, 18 (FIG. 2) that are mounted to the shaft rods 4, 5, 6, 7. The lifting healds 12, 13, as is shown by FIGS. 3 and 4, may each consist of steel bands 12*a*, 12*b*, 13*a*, 13*b* that, between them, include a gap through which extends the limbs of the half heald 14. The steel bands 12*a*, 12*b*, 13*a*, 13*b* may be connected to each other at a connecting site 19, 20. The half heald 14 has, on its lower end in FIGS. 3 and 4, an eye delimited by a strip 21, whereby the leno thread 22 moves through said eye. As opposed to this, the standing thread 23 moves in contact with the half heald 14 past said half heald before extending along the two pull healds 12, 13 between said pull healds.

Figure 8:
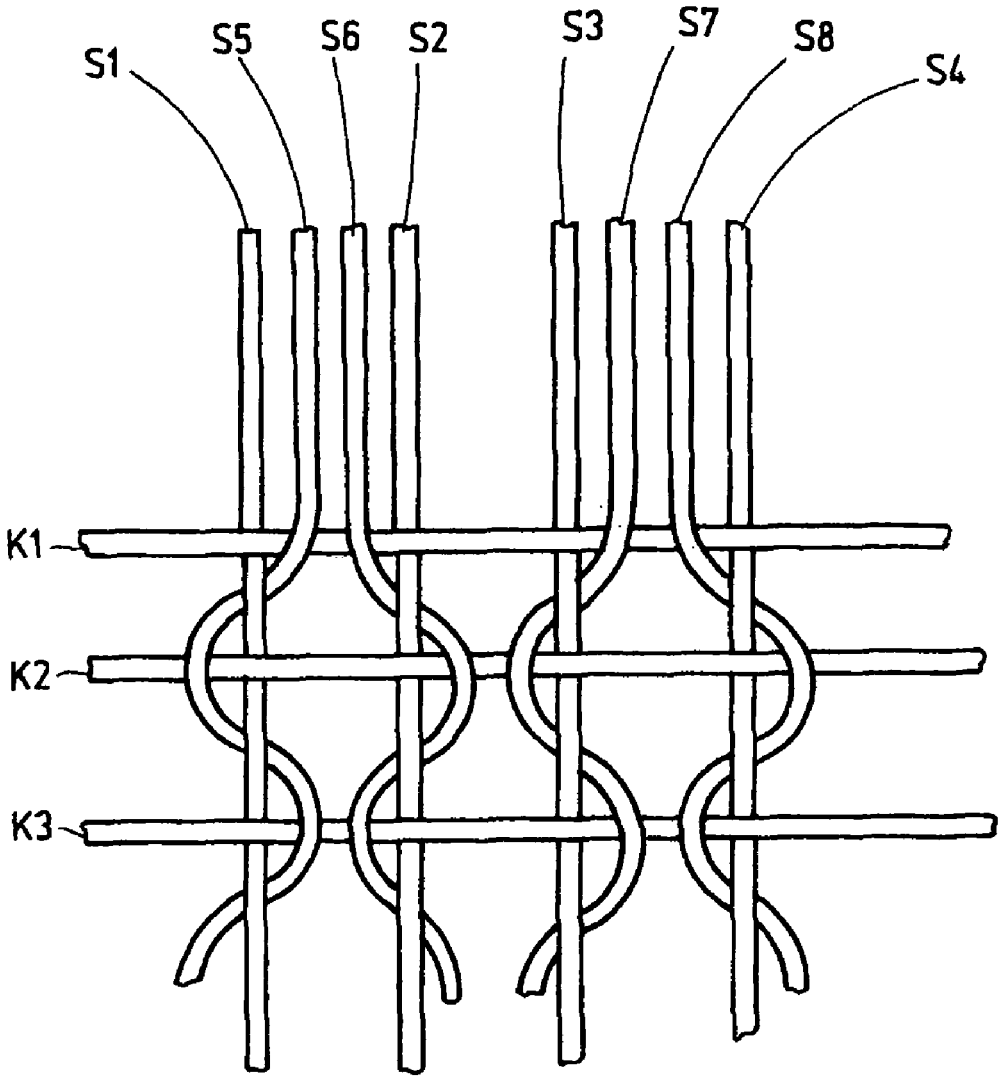
FIG. 8 is a schematic illustration of a leno fabric.

Overall, the half heald 14 is configured as a U-shaped bracket of flat material, whereby its two limb ends are provided with end eyelets 24, 25. These are seated on the heald support rails 26, 27 that, together, form a so-called half shaft 28 (FIG. 8). Among each other, they may be connected by appropriate spacer bolts 29 that, at the same time, provide a connecting site for a transmission 30, that moves the half shaft 28 in vertical direction. This transmission 30 is preferably configured as a link mechanism 31 that connects the upper shaft rods 4, 5 of the pull and lifting shafts with the half shaft 28.

Figure 5:
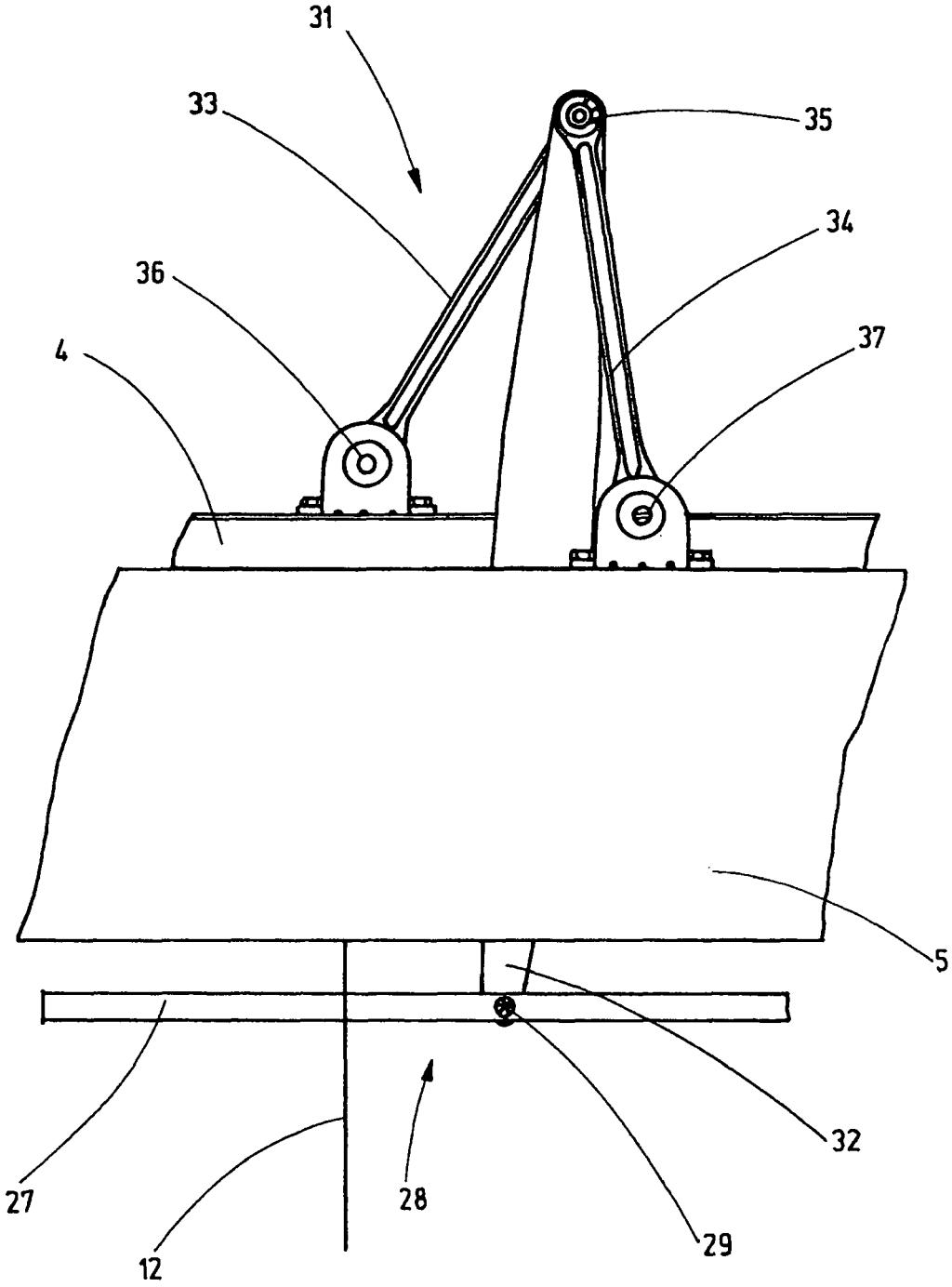
FIG. 5 is an illustration of a detail of the leno device in order to show its link mechanism.

The link mechanism 31 is shown by FIG. 2 and, in particular, also by FIG. 5. The link mechanism 31 comprises a connecting rod 32 that is connected to the half shaft 28 via a connecting rod joint. The connecting rod joint comprises, e.g., a spacer bolt 29 or a not specifically illustrated bearing seated on said connecting rod. The connecting rod 32 extends away from the half shaft 28 between and through the upper shaft rods 4, 5 of the lifting shafts 2, 3 in upward direction. At its upper end, said connecting rod is pin-connected to two connecting levers configured as guide rods 33, 34. To achieve this, a bolt 35 is used, said bolt forming a connecting joint and potentially being provided with separate bearing means.

Figure 6:
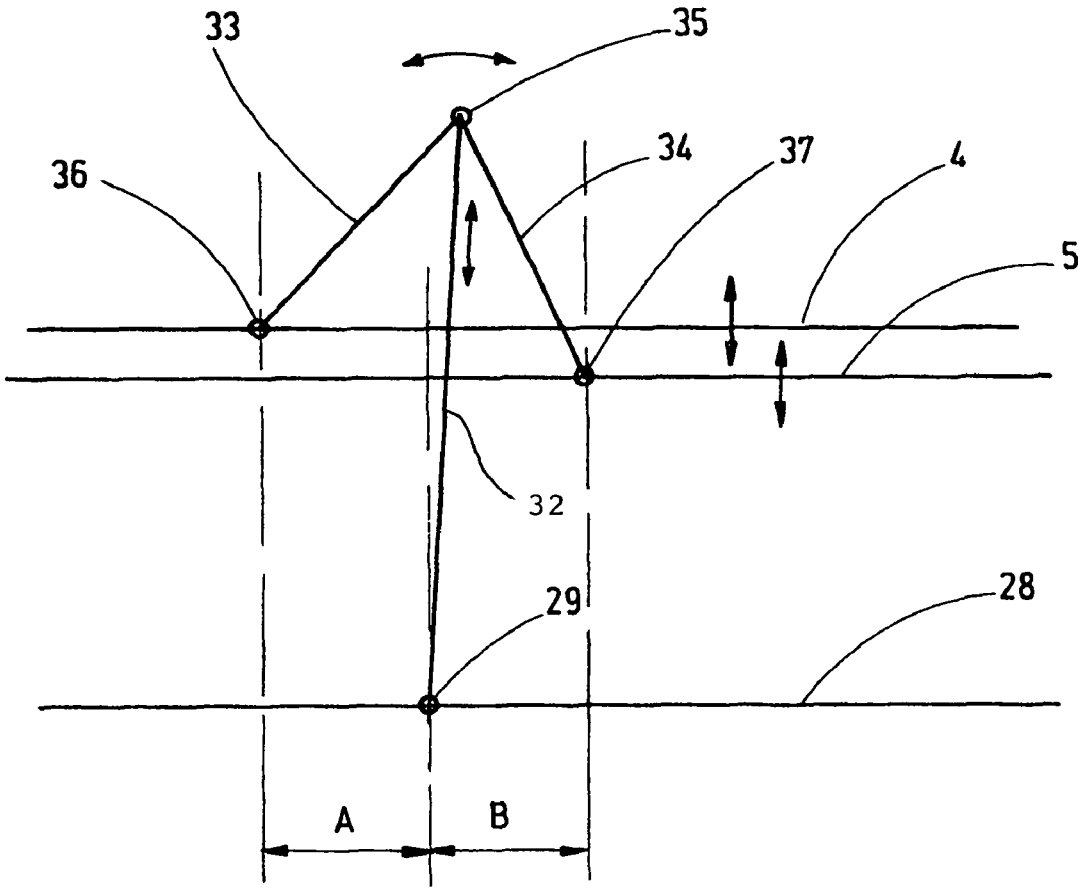
FIG. 6 is an illustration of the kinetics of the link mechanism.

The guide rod 33 is connected to the upper shaft rod 4 via a joint 36. The guide rod 34 is pin-connected with the shaft rod 5 via a joint 37. The joints 36, 37, 35, 29 comprise pivot axes that are aligned parallel to each other and, preferably, are aligned transversely with respect to the shaft rods 4, 5. The guide rods 33, 34 form the connecting levers that act between the upper shaft rods 4, 5 and the connecting rod 32. Preferably, they have the same length, as is shown by FIG. 6. Also, preferably, they are at most half as long as the connecting rod 32. The distances A (between the joints 36 and 29) measured in longitudinal direction of the half shaft 28 and B (between the joints 29 and 37) are preferably of the same length. Also, preferably, the length of the connecting rod 32 is adjustable. In addition, provisions may be made to permit at least one of the joints 36, 37, or also both joints, to be supported so as to be adjustable in longitudinal direction of the shaft rod 4 or 5.

As is shown by FIG. 1, the half shaft 28 is preferably moved via two link mechanisms 31, 31' that are designed so as to be mirror-symmetrical with respect to each other. The guide rod 34 located in front of the connecting rod 32—with respect to the plane of projection—is connected to a joint 37 that is offset to the right relative to the joint 29. The joint 37' of the guide rod 34' located in front of the connecting rod 32' is offset to the left relative to the joint 29'. Conversely, this applies to the guide rods 33, 33' located behind the connecting rods 32, 32'—with respect to the plane of projection—and their joints 36, 36'.

The mirror-symmetrical configuration has the advantage that the moments of inertia and the forces of inertia generated during the operation of the link mechanisms 31, 31' largely compensate each other. With appropriate guidance of the half shaft 28, the link mechanisms 31, 31' may also be the same among each other. Furthermore, several such link mechanisms may be provided. The link mechanisms 31, 31' represent a parallel guide for the half shaft 28.

Figure 7:
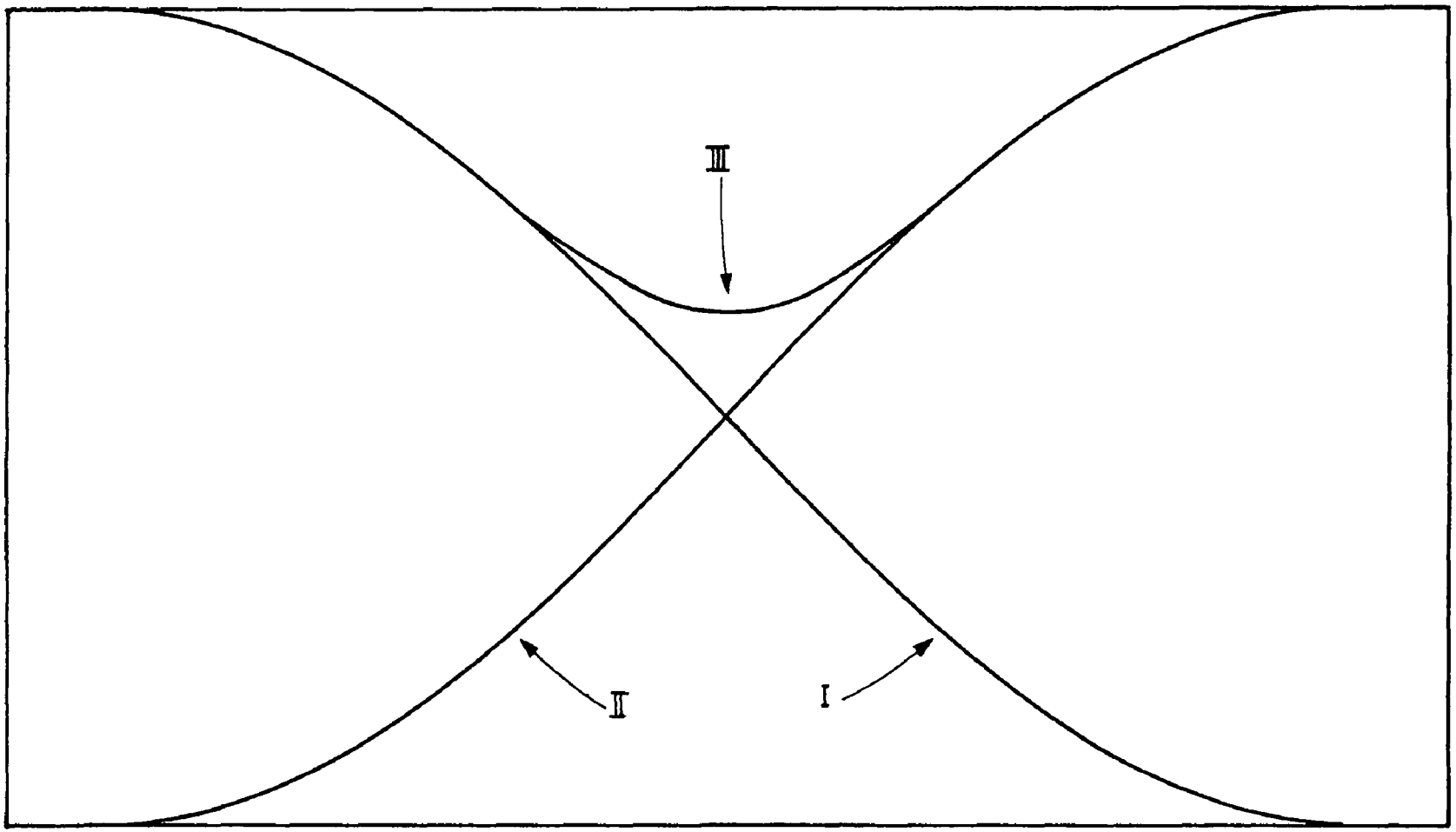
FIG. 7 is a diagram of the motion curves of the lifting shafts and of the half shaft.

The leno device 1 described so far works as follows:

In order to produce a fabric in accordance with FIG. 8 the leno thread 22 (for example, S5, S6, S7, S8 in FIG. 8) is alternately guided on the right and on the left past the standing threads 23 (S1, S2, S3, S4). This is accomplished by the alternating up and down movement of the lifting shafts 2, 3. FIG. 7 illustrates, by means of curve I, the movement of the lifting shaft 2 from its upper position in accordance with FIG. 1 into a lower position. Curve II illustrates the movement of the lifting shaft 3 out of its lower position shown in FIG. 1 into an upper position. Curve III illustrates the movement of the half shaft 28 resulting therefrom. Due to this movement, the leno thread 22 is moved past the standing thread 23. Depending on which of the two lifting shafts 2 or 3 is guided downward and which of the two lifting shafts 2 or 3 is guided upward, the relationships depicted by FIG. 3 or FIG. 4 are the result, i.e., the leno thread 22 is guided—with respect to the plane of projection—in front (FIG. 3) or behind (FIG. 4) of the same in downward direction. Respectively after the weft entry, one of the lifting shafts 2, 3 moves in upward direction while the other lifting shaft then moves in downward direction. This movement is achieved by means of the drive rod assembly 38 that is schematically illustrated by FIG. 1 and that connects the two lifting shafts 2, 3 to different rockers 39, 40 of a dobby 41.

As is obvious, each of the curves I, II, III is without sharp bends and smooth. It is of particular advantage that the half shaft 28 is moved without jerky acceleration.

A leno device uses the link mechanisms 31, 31' to derive the movement of its half shaft 28 from the movement of its pull or lifting shafts 2, 3. The link mechanisms 31, 31' connect the shaft rods 4, 5 of the pull or lifting shafts 2, 3 to the half shaft 28, whereby a connecting rod 32, 32' extends between the two pull or lifting shafts 2, 3 from the top to the bottom through said shafts. The upper end of the connecting rod 32, 32' is connected, on both sides of the connecting rod 32, 32' via connecting levers 33, 34, 33' 34', to the joints 36, 37, 36', 37' that are connected to the upper shaft rods 4, 5 of the pull or lifting shafts 2, 3.

It will be appreciated that the above description of the present invention is susceptible to various modifications, changes and modifications, and the same are intended to be comprehended within the meaning and range of equivalents of the appended claims.

LIST OF REFERENCE NUMERALS:

| | |
|---|---|
| 1 | Leno device/leno shaft |
| 2, 3 | Lifting shafts |
| 4, 5 | Upper shaft rod |
| 6, 7 | Lower shaft rod |
| 8, 9, 10, 11 | Lateral supports |
| 12, 13 | Lifting healds |
| 12a, 12b, 13a, 13b | Steel bands |
| 14 | Half heald |

-continued

| LIST OF REFERENCE NUMERALS: | |
|---|---|
| 15, 16, 17, 18 | Heald support rails |
| 19, 20 | Connecting site |
| 21 | Strip |
| 22 | Leno thread |
| 23 | Standing thread |
| 24, 25 | End eyelets |
| 26, 27 | Heald support rails |
| 28 | Half shaft |
| 29 | Connecting rod joint, spacer bolt |
| 30 | Transmission |
| 31 | Link mechanism |
| 32 | Connecting rod |
| 33, 34 | Guide rod |
| 35 | Bolt |
| 36, 37 | Joints |
| A, B | Distances |
| I, II, III | Curves |
| 38 | drive rod assembly |
| 39, 40 | Rockers |
| 41 | Dobby |

What is claimed is:

1. Leno device comprising:

two lifting shafts (2, 3) that support the lifting healds (12, 13);

a half shaft (28) that supports half healds (14); and a transmission (30) connecting the half shaft (28) to at least one of the lifting shafts (2, 3) in a forcibly coupled manner, wherein the transmission (30) comprises a link mechanism (31) that comprises at least one connecting rod (32) whose one end is pivotally connected to the half shaft (28) at one connecting rod joint (29) and two connecting levers that are configured as guide rods (33, 34), each of said guide rods being pin-connected to the end of the connecting rod (32) that is remote from the half shaft (28).

2. Leno device in accordance with claim 1, characterized in that each of the lifting shafts (2, 3) comprises two heald support rails (15, 17; 16, 18), and that the lifting healds (12, 13) have end eyelets that are seated on the heald support rails (15, 17; 16, 18).

3. Leno device in accordance with claim 1, characterized in that the half shaft (28) comprises at least one heald support rail (26, 27), and that the half healds (14) have end eyelets (24, 25) that are seated on the heald support rail (26, 27).

4. Leno device in accordance with claim 1, characterized in that one of the guide rods (33, 34) is connected, at a first joint (36), to one of the lifting shafts (2, 3), and that the other guide rod (33, 34) is connected, at a second joint (37), to the other of the lifting shafts (2, 3).

5. Leno device in accordance with claim 4, characterized in that the connecting rod joint (29) and the first and second joints (36, 37) each define pivot axes that are aligned parallel to each other.

6. Leno device in accordance with claim 1, characterized in that the two guide rods (33, 34) are of equal length.

7. Leno device in accordance with claim 1, characterized in that the two guide rods (33, 34) are shorter than the connecting rod (32).

8. Leno device in accordance with claim 4, characterized in that the two joints (36, 37) are arranged transversely with respect to their pivot axes at a distance (A and B) from each other.

9. Leno device in accordance with claim 1, characterized in that the transmission (30) comprises two link mechanisms (31) arranged at a distance relative to each other.

* * * * *